United States Patent [19]

Guthrie

[11] 4,078,485

[45] Mar. 14, 1978

[54] PRINT WHEEL CONTROL

[75] Inventor: John Gilkeson Guthrie, Washington, D.C.

[73] Assignee: Computer Entry Systems, Inc., Silver Spring, Md.

[21] Appl. No.: 686,876

[22] Filed: May 17, 1976

[51] Int. Cl.[2] ..... B41J 1/32

[52] U.S. Cl. ..... 101/93.21; 101/110; 250/233

[58] Field of Search ..... 101/93.14, 93.21, 93.22, 101/93.28–93.34, 93.18, 93.19, 95, 99, 110, 111; 197/53, 133 R; 318/626–628, 678; 226/108, 162

[56] References Cited

U.S. PATENT DOCUMENTS

| | | | |
|---|---|---|---|
| 3,110,251 | 11/1963 | Scheffel | 101/93.28 |
| 3,158,090 | 11/1964 | Wasserman | 101/93.29 |
| 3,440,955 | 4/1969 | Howard et al. | 226/108 X |
| 3,566,782 | 3/1971 | Kocher | 250/233 X |
| 3,741,112 | 6/1973 | Cayla | 101/93.21 |
| 3,807,300 | 4/1974 | Brooks et al. | 101/93.21 |
| 3,901,371 | 8/1975 | Scott | 197/53 |

*Primary Examiner*—Edward M. Coven
*Attorney, Agent, or Firm*—Oblon, Fisher, Spivak, McClelland & Maier

[57] ABSTRACT

A control system for operating a single high-speed print wheel is disclosed. The control system includes a print wheel drive motor having a coded disc with transparent portions forming a four-level Gray code for indicating the position of the print wheel. An optical and electronic system is used for positioning the print wheel and also for the purpose of providing an electronic detent which uses the motive power of the print wheel drive for holding the print wheel in selected printing positions. A similar optical and electronic system is used for controlling a paper advance mechanism. The disclosed system also includes a print hammer with a voice coil type drive to permit positive, bidirectional hammer control.

14 Claims, 10 Drawing Figures

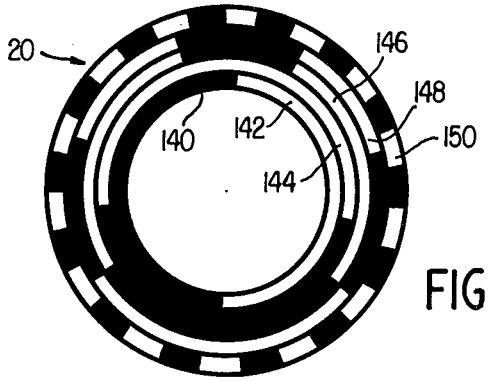
FIG. 2
FIG. 7
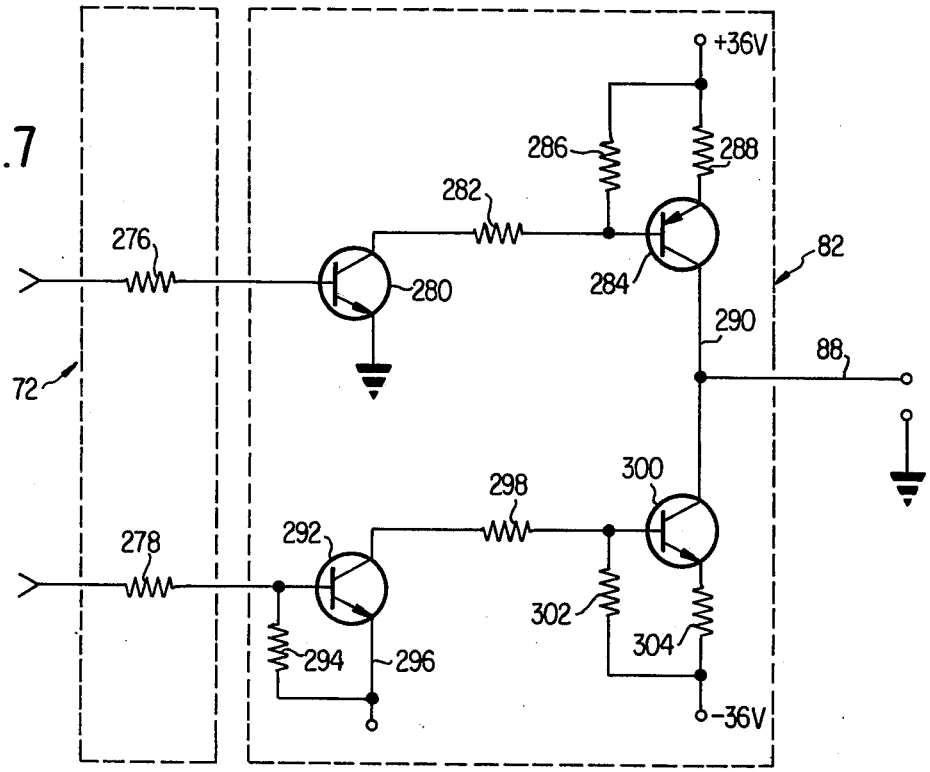
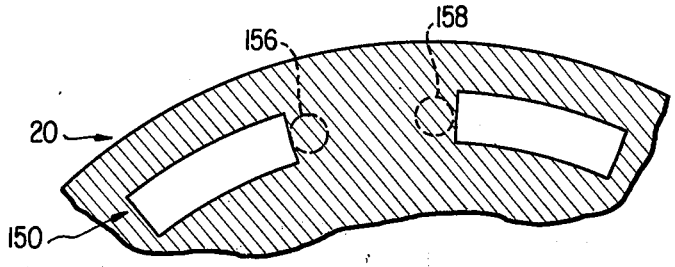
FIG. 10

PRINT WHEEL CONTROL

BACKGROUND OF THE INVENTION

1. Field of the Invention:

The present invention relates to a printing system, and more particularly to a system for controlling a single high-speed print wheel using an opto-electronic control system.

2. Description of the Prior Art:

A need presently exists in the banking and payment processing fields for a reliable print control system which is particularly suitable for use with a single line printer.

One specific environment in which such a printer is needed is in the field of automatic check processing by commercial banks. In check processing, banks normally handle tremendous volumes of checks to be cleared for payment. These checks are processed through high-speed handling equipment which reads the magnetic characters printed on the checks. However, in a certain percentage of the checks processed, it has been found that the magnetic characters lack a sufficient amount of magnetic material to be accurately sensed by the high-speed handling equipment. As a result, many checks are ejected from the high-speed equipment as unreadable. These checks must, of course, still be processed. In the past, checks ejected from high-speed handling equipment were often processed manually, resulting in a considerable increase in processing costs and a considerable expenditure of time. Thus it is highly desirable that a system be provided for automatically handling these rejected checks, so that they may be reinserted into high-speed handling equipment as rapidly as possible.

In this regard it is noted that, while magnetic characters printed on checks occasionally lack sufficient intensity to be read magnetically, they still often include a sufficient amount of optical distinctiveness to be read by optical character reading equipment. Thus, it is possible to optically read characters which are printed with an insufficient magnetic intensity, and then to reprint these characters magnetically on an additional strip of paper which is automatically attached to the defective check by conventionally known automated equipment. However a need exists for a reliable system to conduct this reprinting of checks in a highly accurate manner which is clearly and easily readable by high-speed processing equipment.

There is also a need for a single line printer for the purpose of encoding the amount field in conventional magnetic characters so that the checks can be entirely processed automatically. The need for amount field encoders extends to both payment processing divisions of companies receiving direct payments and to commercial banks.

Printers have been available in the past to provide a variety of printing functions, including those specifically mentioned above. However, reliable printers for achieving the desired effect have proven to be extremely complicated and costly in nature. Accordingly, a significant need exists for a high-speed reliable printer which is simple in structure and operation, is low in cost and is easily adapted to operate with other automated systems. In producing such a printer, it is preferred that mechanical parts be minimized since mechanical parts have proven to be the most susceptible to failure in printers of the type in question. Furthermore, mechanical parts such as mechanical detenting devices and similar apparatuses are subject to wear with the result that, after extensive usage, excessive play becomes a factor which results in printing errors or ambiguities, tending to reduce the legibility of printed characters.

SUMMARY OF THE INVENTION

Accordingly, one object of the present invention is to provide a novel printing system of low cost and high reliability.

Another object of the present invention is the provision of a novel single line printing system of high reliability which employs a minimum of moving parts.

A still further object of the present invention is the provision of a novel single line printing system which employs a novel electronic detenting system.

A still further object of the present invention is the provision of a low cost, highly simplified, high speed single line printing system, which is particularly suitable for use in combination with automated check handling equipment.

Yet another object of the present invention is the provision of a novel printing system which includes an electronically controlled paper advance and print wheel activating system, and further includes a print hammer driven by a voice coil type actuator.

Another object of the present invention is the provision of a printer which employs similar opto-electronic control systems for performing print wheel control and paper advance functions.

Briefly, these and other objects of the present invention are achieved by the provision of a printing system including a single line print wheel, a printing hammer and a paper advance mechanism. The print wheel and paper advance mechanisms are controlled by similar motors, each of which has coupled to it a coded disc having transparent portions forming position indicators. In the case of the print wheel, the coded disc includes a four-level Gray code for permitting absolute indication of the position of the print wheel. An optical network utilizing photo-transistors is used to read out the position of the code wheel and also to provide an electronic detenting arrangement wherein the power of the motive system is used to hold the print wheel in position. A hammer drive which employs a voice-type coil is used for driving the print hammer in both directions for increasing the hammer speed and improving the quality of printed characters.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is a plan view of the code wheel used in accordance with the present invention;

FIG. 7 is a schematic circuit diagram of the hammer drive circuit of the present invention;

DESCRIPTION OF THE PREFERRED EMBODIMENTS

Figure 1:
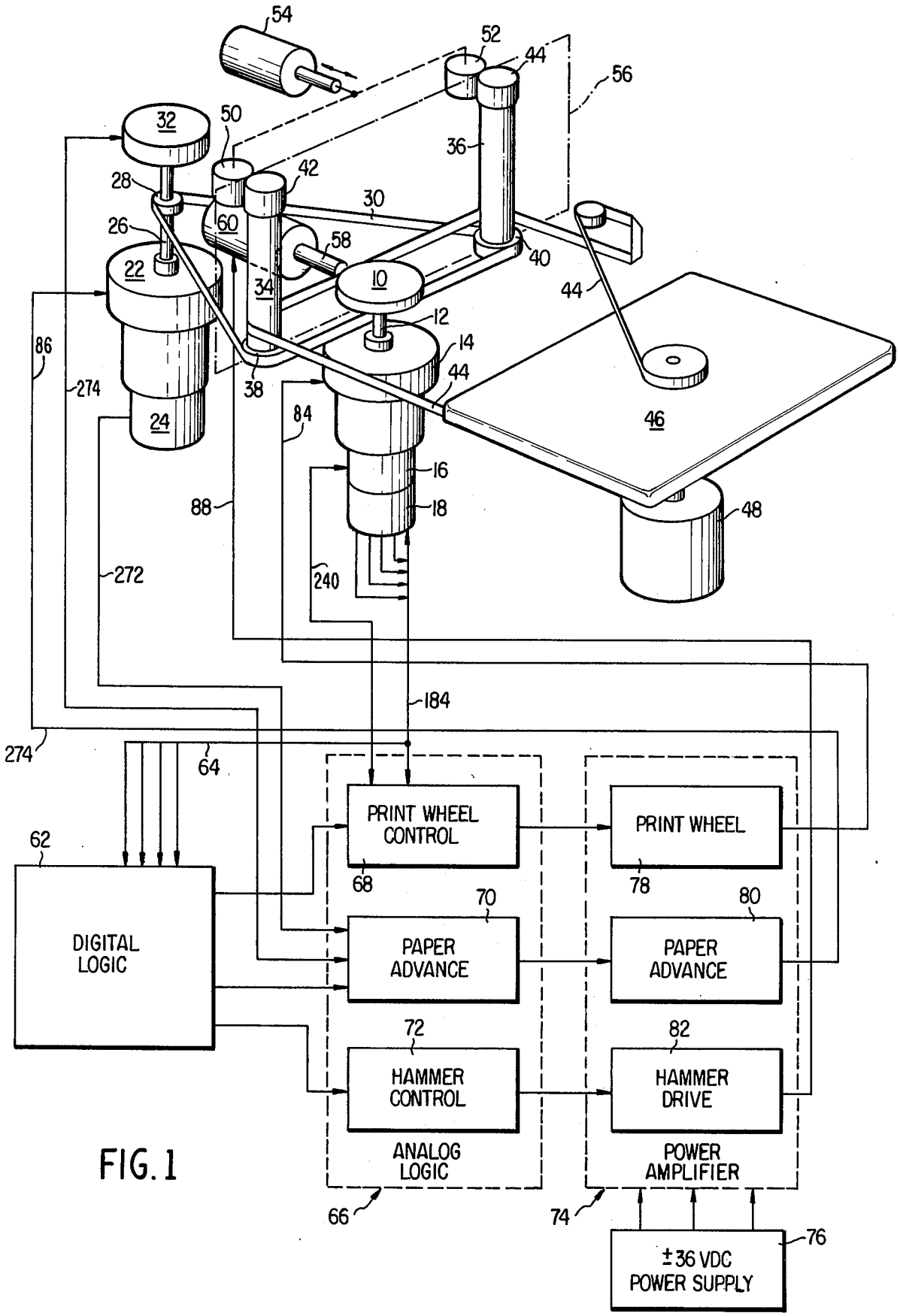
FIG. 1 is a partially schematic perspective illustration of the mechanical arrangement of the system of the present invention.

Referring now to the drawings, wherein like reference numerals designate identical or corresponding parts throughout the several views, and more particularly to FIG. 1 thereof, the mechanical arrangement of the printing system of the present invention is illustrated. The illustrated system includes a print wheel 10, which may be of the conventional 14 facet variety on which characters of any suitable variety are engraved. The print wheel 10 is coupled to the drive shaft 12 of a print wheel motor 14. The print wheel motor is preferably a very high torque motor which accelerates in an extremely short time to a high velocity, so that a high printing speed can be maintained by the system. The motor is preferably a conventional motor which can be commercially obtained, such as a Microswitch 33 VM moving coil servomotor. This motor comes equipped with a conventional rate tachometer 16 which is coupled to the motor for providing an output signal representative of the motor speed.

An electronic detent and shaft and coder assembly 18 is physically mounted to the motor housing adjacent the rate tachometer 16. The electronic detent and shaft encoder assembly is not a conventional portion of the motor but is an optical and electronic circuit constructed in accordance with the teachings of the present invention, the details of which will be explained subsequently with reference to FIGS. 3 and 4. The detent and shaft encoder assembly 18 includes a code wheel 20 of the type illustrated in FIG. 2. The code wheel is mounted on an extension of the drive shaft 12, and is thus rigidly coupled to the print wheel 10 for rotation therewith. The code wheel is used to provide an absolute indication of the position and movement of the print wheel 10.

A similar system is illustrated for controlling motion of the paper or record past the print wheel. This system includes a paper advance motor 22, which is also preferably a conventional, commercially available unit. The preferred motor is a Microswitch 2VM moving coil servometer having a general configuration and general characteristics that are very similar to the print wheel motor 4. The primary difference between the two motors is that the paper advance motor is a lower power apparatus since it operates simply as an incremental advance drive for paper motion, and thus does not require highspeed reversibility or the acceleration of the print wheel drive motor. The paper advance motor also includes a rate tachometer 24 as an integral part thereof for indicating motor speed. The motor 22 includes a drive shaft 26 on which is mounted a drive pulley 28 for imparting drive motion to a capstan drive belt 30. An electronic detent assembly 32, constructed in accordance with the principles of the present invention and described in more detail subsequently, is secured to the drive shaft 26. The detent assembly 32 also includes a code wheel 20 coupled to the drive shaft 26 for rotation therewith. The detent assembly 32 is shown coupled to the upper end of the motor 22 for purposes of design convenience, but could equally well be mounted at the lower end of the motor in the same fashion as the previously described detent and shaft encoder assembly 18.

The capstan drive belt 30 is coupled to a pair of document driving capstans 34 and 36 having driving pulleys 38 and 40 at their respective lower ends and idler rollers 42 and 44 at their respective upper ends. The central shaft of each capstan has a reduced diameter relative to the driving pulleys and idler rollers for permitting a print ribbon 45 to pass around the capstans without physically engaging a document being moved through the capstan assembly. The print ribbon, which is preferably a conventional ribbon carrying magnetic ink, is contained in a conventional ribbon cassette 46 which is driven by a conventional ribbon pickup motor 48.

A pair of movable pinch rollers 50 and 52 are shown cooperating with the capstans 34 and 36, and are movable into and out of engagement with the capstan pulleys by means of a solenoid 54. A document path or plane 56 is thus defined between the capstans and the pinch rollers. A print hammer 58 driven by a hammer coil 60 is positioned opposite the print wheel 10 for striking a passing document from the rear to impress the document against the ribbon 44 and the print wheel 10, whereby a character is printed on the front of the document.

The operation of the pinch rollers 50 and 52 is such that they may normally be spaced from the capstans 34 and 36, whereby an open document path exists between the pinch rollers and the capstans. Thus documents not requiring printing can be rapidly passed through the illustrated assembly without stopping. When it is desired to stop and print a document, the solenoid 54 is actuated by any conventional means, such as a photocell circuit, to engage the pinch rollers with the capstans whereby subsequent documents are stopped in the system for printing. Motion of the document through the illustrated printing apparatus is then under the control of the paper advance motor and printing is accomplished in accordance with the specific control system of the present invention, which will be explained in more detail subsequently.

Operation of the above-described mechanical components is controlled by the circuitry illustrated in block diagram form at the bottom of FIG. 1. Specifically, a digital logic network 62 is shown which is directly coupled to the detent and shaft encoder 18 of the print wheel control over a line 64, and which is also coupled to analog logic 66. The analog logic 66 is divided into three separate components including print wheel control circuits 68, paper advance circuits 70 and hammer control circuits 72. These various circuits comprising the analog logic are each coupled to a power amplifier 74 which includes a plus or minus 36-volt DC power supply 76. The power amplifier 74 is similarly divided into three separate amplifier components including a print wheel circuit 78, a paper advance circuit 80, and a hammer drive circuit 82. The outputs of these three power amplifier circuits are respectively coupled over lines 84, 86 and 88 to the print wheel motor 14, the paper advance motor 22 and the hammer coil 60.

Figure 3:
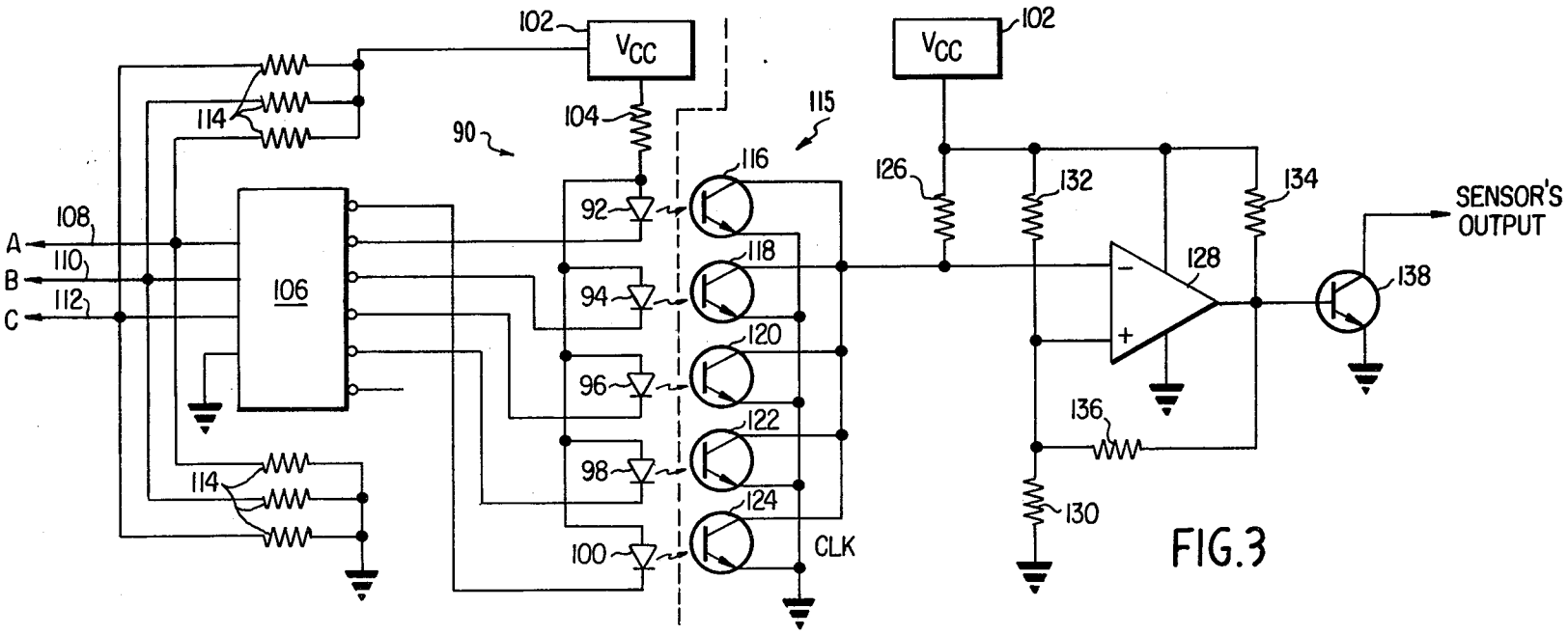
FIG. 3 is a schematic circuit diagram illustrating the optical and electronic control system for reading the position of the code wheel illustrated in FIG. 2.

Attention is now directed to FIG. 3 which illustrates the electrical and optical network utilized in reading the code wheel 20 included in the detent and shaft encoder 18 for indicating the position of print wheel 10. This device includes an LED decoder circuit 90 including five LEDs 92 - 100. The anode of each of the LEDs is coupled to a voltage source 102 through a current limiting resistor 104, while the cathode of each LED is coupled to one output terminal of a conventional, commercially available binary to decidecoder 106. The input to the decoder 106 is supplied over three lines 108, 110 and 112 which are coupled to the digital logic 62, as will be explained in more detail subsequently. These three lines carry binary input signals for sequentially energizing the LEDs 92 - 100. Suitable termination circuitry is provided in the form of pairs of voltage dividing resistors 114 coupling each of the lines 108 - 112 between the voltage source 102 and a suitable reference potential, such as ground.

Five phototransistors 116 - 124 are provided for sensing the optical outputs of the LEDs 92 - 100. The emitter electrodes of the phototransistors 116 - 124 are coupled to a suitable reference potential such as ground, while the collector electrodes of each of the phototransistors are coupled together and the interconnected collector electrodes are coupled through a biasing resistor 126 to a suitable voltage source, such as the previously described voltage source 102. The interconnected collector electrodes are also coupled to the negative input of a conventional differential amplifier 128, the positive input of which is provided with a suitable reference potential by means of voltage dividing resistors 130 and 132. Other conventional biasing and feedback resistors 134 and 136 are coupled to the differential amplifier in the conventional manner. The output of the differential amplifier 128 is applied to the base electrode of an output amplifying transistor 138, which is coupled to a reference potential such as ground at its emitter electrode and which is coupled to the print wheel control circuit 68 at its collector electrode.

Before describing the operation of the LED decoder circuit 90, the physical cooperation of the circuit with respect to the code wheel 20 must be understood. Briefly, the portion of the circuit 90 containing LEDs 92 - 100 is preferably contained on a first circuit board, while the portion of the circuit 115 containing the phototransistors 116 - 124 is preferably on a separate circuit board. The code wheel 20 is positioned between the two circuit boards so as to be sandwiched between them. The code wheel includes a central aperture 140 where it fits over the motor drive shaft. Extending outwardly from the central aperture 140 are five concentric coded circles or rings 142 - 150, each of which includes one or more transparent areas separated by opaque areas. These concentric coded circles form a four-level Gray code for identifying the angular position of the motor drive shaft, and thus of the print wheel 10. The outermost ring 150 includes a plurality of alternate transparent and opaque areas of substantially the same dimensions. This outermost ring serves as a clocking ring and also acts as a portion of the electroding detenting circuit, to be described subsequently.

The operation of the LED decoder circuit 90 is such that it sequentially reads the position code provided by the four inner rings 140 - 148 of the code wheel when interrogated, and otherwise supplies clock pulses from the outer ring 150 of the code wheel. When the print wheel is stopped, the code wheel 20 is, of course, also stopped and presents a particular code of transparent and opaque areas between the LEDs 92 - 98 and the corresponding phototransistors 116 - 122, which are arranged directly opposite the respective LEDs, but on the opposite side of the code wheel 20. A series of sequential interrogating signals in binary fashion are subsequently supplied from the digital logic circuitry over lines 108, 110 and 112. These sequential binary signals are decoded by the binary to decimal decoder 106 for sequentially energizing the five LEDs 92 - 100. As each of the LEDs is actuated, the light pulse it generates is either transmitted to the corresponding phototransistor, provided a transparent area of the code wheel separates the two, or is blocked by an opaque area of the code wheel. Since the LEDs are interrogated (i.e. illuminated) in order, the pulse sequence supplied at the output of the phototransistor circuit 115 provides a sequentially ordered readout defining the position of the code wheel.

Figure 4:
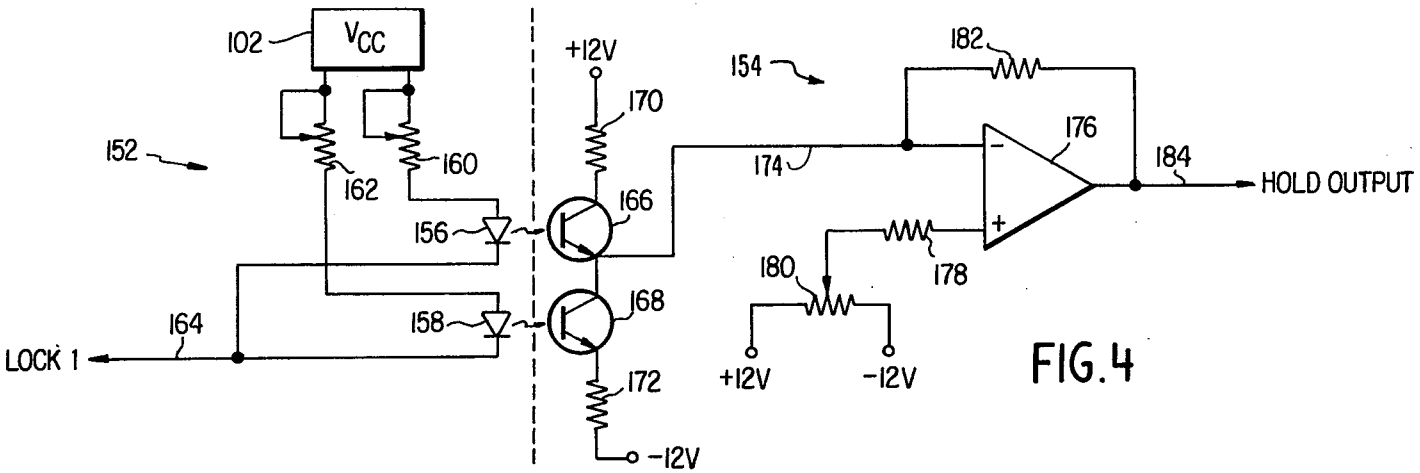
FIG. 4 is a schematic circuit diagram of the optical and electronic circuit used in accordance with the code wheel of FIG. 2 to provide an electronic detenting action.

Attention is now directed to FIG. 4 which illustrates the electronic detenting circuitry of the present invention. The electronic detenting circuitry includes LED circuitry 152, which is physically positioned on the same circuit card as the previously described LED decoder circuit 90, and a detector circuit 154, which is physically positioned on the same printed circuit card as the previously described phototransistor circuit 115. In other words, the code wheel 20 is positioned between the LED detent circuit 152 and the detector circuit 154. The LED detent circuit 152 includes two LEDs 156 and 158, both of which are coupled at their anodes to a suitable source of DC potential 102 through respective balancing potentiometers 160 and 162. The cathodes of both LEDs are coupled together and are connected via a line 164 to digital logic 62. The two LEDs 156 and 158 are thus simultaneously switched on or off depending upon the signal on Line 164.

The detector circuit 154 includes two phototransistors coupled together in a complementary or push-pull mode. More specifically, the collector electrode of the phototransistor 166 is coupled through a current limiting resistor 170 to a suitable source of DC potential, while the emitter electrode of that transistor is coupled to the collector electrode of phototransistor 168. The emitter electrode of the phototransistor 168 is in turn coupled through a second current scaling resistor 172 to a suitable source of negative DC potential. The interconnected emitter of phototransistor 166 and collector of phototransistor 168 are connected by means of a line 174 to the negative input of a differential amplifier 176, the positive input of which is coupled through a current limiting resistor 178 to an absolute offset adjustment potentiometer 180. A feedback resistor 182 is coupled across the differential amplifier 176 and interconnects the line 174 with an output line 184 which is coupled to the print wheel power amplifier circuitry. The feedback resistor 182 is preferably related to the current limiting resistor 170 so that a feedback factor of approximately 10 is provided across the amplifier 176.

The operation of the detent circuit can be understood by reference to FIG. 4 and to FIG. 10 which illustrates the physical positioning of the LEDs 156 and 158 relative to code wheel 20. As shown in FIG. 10, the LEDs 156 and 158 are positioned adjacent the code wheel 20, and specifically adjacent to the outermost concentric ring 150 of alternate transparent and opaque areas on the code wheel 20. The LEDs are separated by a distance such that they can both be blocked, or nearly blocked, by one of the opaque regions in the circle or ring 150, all of which have the same dimensions. In operation, the system is first balanced by adjustment of the absolute offset adjustment potentiometer 180 when the two LEDs are off, the system is again balanced by adjustment of the balancing potentiometers 160 and 162 to take into account unequal illumination of the two LEDs. When the system is in balance, and it is desired to lock the print wheel into a position, a lock signal is applied to the line 164, causing both LEDs 156 and 158 to be illuminated. According to the arrangement of the invention, the lock signal is applied at the end of a motion interval, and normally occurs at a position such that one of the two LEDs is adjacent a transparent segment of the code wheel, while the other is blocked by an opaque area. If, for example, the LED 156 is adjacent the opaque area, phototransistor 166 is rendered conductive and a large current flows into the differential amplifier 176. Thus, a strong feedback effect is created which attempts to neutralize the input current, creating a powerful output signal on line 184 which rapidly drives the motor in the proper direction to null the input delivered to the differential amplifier by moving the code wheel to block both of the LEDs. Once the illustrated circuit is locked into position, a strong electronic detenting effect is produced since movement of the motor shaft and any of the components attached to it is resisted by the power of the motor, since a slight movement in the motor shaft creates an unbalanced illumination of one of the phototransistors 166 or 168, immediately creating a powerful position correcting signal on output line 184 due to the feedback circuit provided across the amplifier 176. Accordingly, a very firm and positive and detenting action is provided by the combined circuits 152 and 154.

Figure 5:
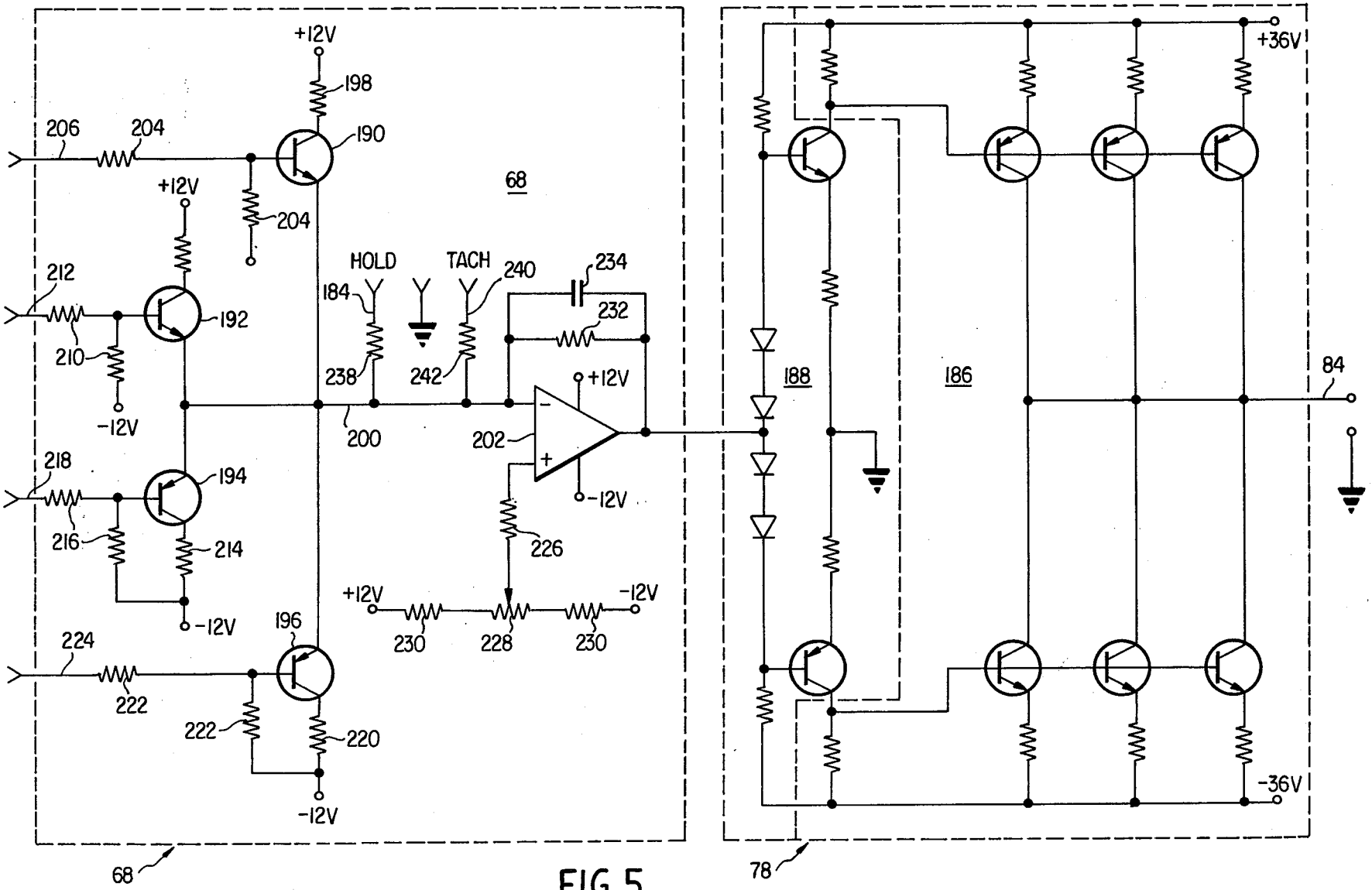
FIG. 5 is a schematic circuit diagram illustrating details of the power amplifier and analog logic used in the print wheel drive circuit.

Attention is now directed to FIG. 5 which illustrates the details of the print wheel analog logic 68 and the print wheel power amplifier 78. The power amplifier 78 is essentially a conventional power amplifier circuit consisting of three complementary Darlington current amplifier stages 186 and a standard voltage offset predriver circuit 188. The operation and construction of these circuits are well known to those skilled in the art, and thus a detailed description of them is not necessary and is omitted for purposes of brevity.

The analog logic print wheel control 68 provides input signals for driving the print wheel power amplifier 78. This circuit includes four switching transistors 190, 192, 194, and 196 for respectively signaling the print wheel motor to turn fast counterclockwise, slow counterclockwise, slow clockwise or fast clockwise. The transistor 190 is coupled at its collector electrode through a scaling resistor 198 to a suitable potential source, and at its emitter electrode to a line 200 which feeds into the negative input of a conventional differential amplifier 202. The base electrode of the transistor 190 is coupled to biasing resistors 204, and to an instructional input line 206 for receiving switching instructions from the digital logic 62. The transistor 192 is similarly coupled at its collector to a suitable DC potential source through a scaling resistor 208, and at its emitter electrode to the line 200. The base of the transistor 192 is coupled to biasing resistors 210 and to an instructional input line 212 which is similarly coupled to the digital logic for receiving an instructional input. The transistor 194 similarly has its emitter coupled to the line 200 and its collector coupled through a scaling resistor 214 to a suitable source of potential. It is noted that the transistors 194 and 196 are of inverted polarity with respect to the transistors 190 and 192. The base electrode of the transistor 194 is coupled to biasing resistors 216 and to an instructional input line 218 coupled to the digital logic. The transistor 196 similarly is coupled at its collector electrode to a scaling resistor 220, and at its base electrode to biasing resistors 222 and to an instructional input line 224 coupled to the digital logic.

As pointed out above, all of the switching transistors 190 – 196 are coupled to the negative input of differential amplifier 202. The positive input of this amplifier is coupled through a resistor 226 to a zero drift adjustment balanced about ground, and comprising a potentiometer 228 and a pair of voltage dividing resistors 230 which are coupled to suitable potential sources. A feedback network including a resistor 232 and a capacitor 234 is provided between the output 236 and the negative input of the amplifier 202.

In addition to the signals from the switching transistors 190 – 196, the differential amplifier 202 receives two external inputs. The first of these is the "hold" or detent input which is supplied from the output line 184 of the circuits shown in FIG. 4 and is connected to the line 200 through a coupling resistor 238. The second external input is the rate tachometer input from the rate tachometer 16 of motor 14. This input is supplied over a line 240 and is connected to the line 200 through a coupling resistor 242.

The analog print wheel control circuit 68 operates to receive clockwise or counterclockwise rotation signals from the digital logic 62. These signals are simply switching signals which selectively render the transistors 190 – 196 conductive. These signals are fed through the differential amplifier 202 to the power amplifier 78 for supplying output power to drive the motor 14. As the motor operates, the rate tachometer 16 generates an output proportional to the motor speed, and this output is fed through the line 240 to the input of the differential amplifier 202. The components in the feedback circuit across the amplifier are selected for balance at a motor speed of 3,000 rpm, for example. Clearly, other motor speeds could be selected by adjusting the components, as will be apparent to those skilled in the art. When the print wheel is stopped for printing, a hold signal is applied over the line 184 from the detent circuitry of FIG. 4 so that the previously described electronic detenting action can take place. It should be noted that the circuitry of the present invention is arranged so that the hold signal can only occur when the motors has been signaled to stop by the control logic.

Figure 6:
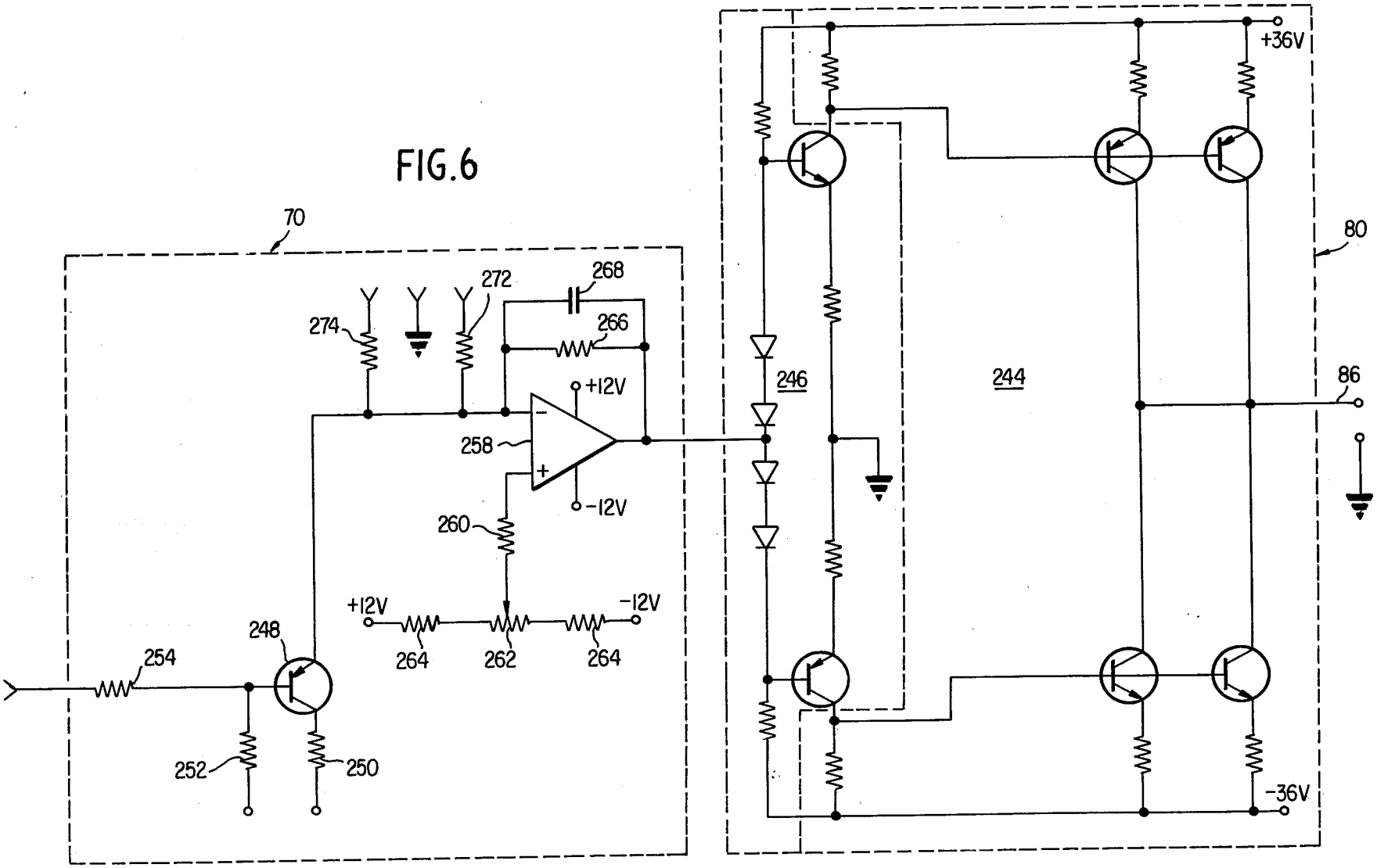
FIG. 6 is a schematic circuit diagram of the amplifier and analog logic circuits used for the paper drive mechanism.

Attention is now directed to FIG. 6 which illustrates the analog logic and power amplifier for the paper advancing system of the invention. The amplifier 80 of FIG. 6 is essentially identical to the amplifier 78 of FIG. 5 with the exception that fewer stages of amplification are used since the paper advance motor 22 requires less driving power than the print wheel motor 4. Specifically, the paper advance amplifier is shown as including two complementary Darlington pairs 244 and a voltage offset predriver circuit 246 which is essentially identical to the circuit 188 of FIG. 5. Again, the predriver circuit and the Darlington amplifier arrangement are strictly conventional circuits, the operation of which is well known to those skilled in the art, and thus need not be set forth in detail here.

The paper advance analog logic 70 is also generally similar to the print wheel analog logic 68, with the exception that it includes only one switching transistor 248. This transistor is coupled through a scaling resistor 250 to a suitable source of DC potential at its collector electrode and is coupled to a pair of biasing resistors 252 at its base electrode. Its base electrode is also coupled to an input control line 254 which receives paper advance signals from the digital logic 262. The emitter electrode of the transistor is coupled over a line 256 to the negative input of a differential amplifier 258. The positive input of the differential amplifier is coupled through a resistor 260 to a zero drift adjustment including a potentiometer 262 which is positioned between a pair of voltage dividing resistors 264 which are in turn coupled to positive and negative sources of DC potential. A feedback circuit including a resistor 266 and a capacitor 268 is coupled between the negative input of the amplifier 258 and its output, which is coupled via a line 270 to the predriver circuit 246 of power amplifier 80.

In addition to the input signal received through the switching transistor 248, the amplifier 258 also receives an input from the rate tachometer 24 of paper advance motor 22 over a line 272 the rate tachometer signal is, of course, again used to establish a maximum speed for the paper advance motor. Selection of the desired speed (3,000 rpm, for example) is achieved by selecting the proper feedback components for the amplifier 258. When the paper advance motor is to be stopped, a hold signal is received over a line 274 coupled to the electronic detent assembly 32 of the paper advance mechanism. The electronic detent assembly 32 includes a circuit that is identical to that of FIG. 4, and utilizes a code wheel of the type shown in FIG. 2. Naturally, it will be understood that a code wheel used in the paper advance system only requires the outermost ring 150 of alternate transparent and opaque areas, and does not require the inner coded rings since no absolute position information is required. However, it is particularly economical to simply produce a large number of identical code wheels which can be used for both the print wheel control and the paper advance control. The electronic detent assembly of the paper advance mechanism is thus identical to the electronic detent assembly of the print wheel control.

In operation, paper advance signals are received over the line 254 from the digital logic to trigger the switching transistor 248, which in turn causes the amplifier 258 to generate a control signal on the line 270, causing the Darlington amplifier 244 to supply a driving signal over the line 86 to the paper advance motor 22. The motor accelerates until the output from the rate tachometer supplied on the line 272 balances the amplifier input when the motor reaches the desired operating speed. When the paper advance motor is stopped, the electronic detent circuit is actuated to produce a hold signal which is supplied over the line 274 to cause the paper advance motor to take on its electronic detenting function.

Attention is now directed to FIG. 7 which illustrates the hammer drive and power amplifier circuit. The hammer control circuit 72 essentially amounts to a coupling circuit between the digital logic 62 and the hammer drive amplifier 82, and comprises simply a pair of coupling resistors 276 and 278 which carry the "hammer in" and "hammer out" commands, respectively, from the digital logic circuit. The coupling resistor 276 is coupled to the base electrode of a predriver transistor 280, which is grounded at its emitter and connected through a coupling resistor 282 to the base electrode of a power amplifier transistor 284. The power amplifier transistor 284 includes a biasing resistor 286 coupled to its base electrode and a second biasing resistor 288 coupled to its emitter electrode. Both biasing transistors are also coupled to a suitable source of positive DC potential. The collector of the transistor 284 is coupled through a line 290 to output line 88 which is coupled to the hammer drive coil.

Coupling resistor 278 is connected to a circuit that is complementary to the above-described circuit. Specifically, this circuit includes a predrive transistor 292 having a biasing resistor 294 coupled to its base electrode and having its emitter electrode coupled to a suitable source of positive potential over a line 296. The collector of the predriver transistor is connected through a coupling resistor 298 to the base electrode of a second power amplifier transistor 300. This transistor is of the opposite polarity with respect to transistor 284, and is arranged in combination with that transistor to form a single stage complementary Darlington push-pull output amplifier. A biasing resistor 302 is coupled to the base electrode of the transistor 300, while the emitter of the transistor is coupled through a biasing resistor 304 to a suitable source of negative DC potential.

The operation of the circuit FIG. 7 is such that a "hammer in" signal from the digital logic produces a current signal in one direction driving the hammer coil 60 so that the hammer 58 is retracted, while a "hammer out" signal from the digital logic results in a current of the opposite polarity which drives the hammer 58 out to result in the accomplishment of a printing operation.

Figure 8:
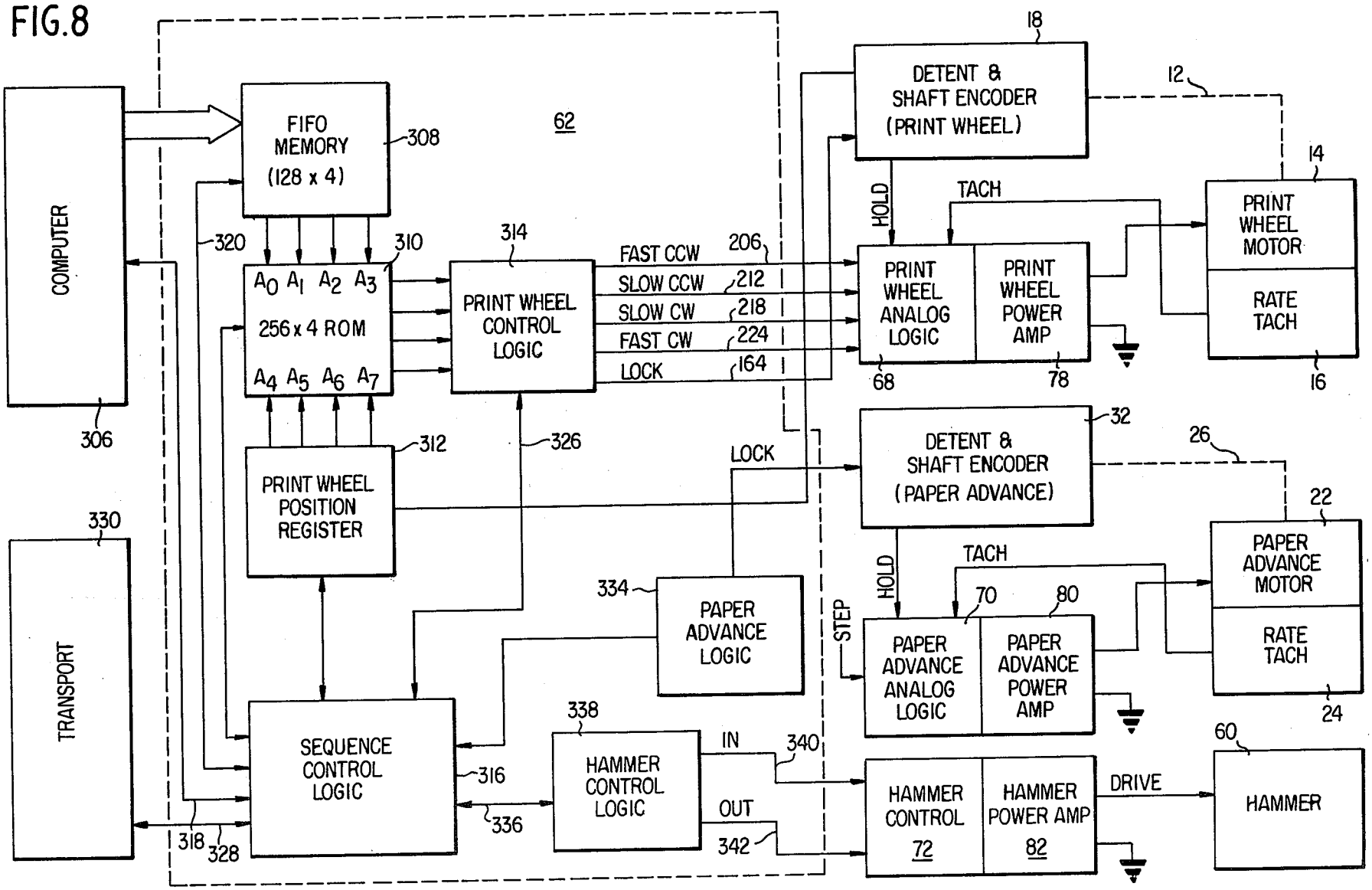
FIG. 8 is a logic block diagram illustrating the digital logic used for controlling the apparatus of the present invention.

Attention is now directed to FIG. 8 which provides a complete block diagram of the system of the present invention showing the details of the digital logic 62. The digital logic 62 is coupled to a conventional computer 306 which is in turn coupled to data reading equipment, or equivalent equipment, depending upon the information to be printed. In the environment of the banking industry, for example, the computer may be coupled to an optical character reader which scans magnetically illegible characters on a check and indicates to the computer what characters are to be printed by the printer of the present invention. Such equipment is in itself standard and does not comprise a portion of the present invention.

The output from the computer identifying the characters to be printed is fed to a standard first in, first out (FIFO) memory 308 preferably having a 128 × 4 capacity. The memory serves as a temporary storage or buffer memory in which characters are stored for a brief interval before being read out into a read only memory 310, preferably having a 256 × 4 capacity and having four channel parallel input and output capability. Read only memories of this type are conventional and commercially available, as is well known to those skilled in the art. A code identifying the character to be printed is supplied to the ROM 310 at inputs $A_0$ through $A_3$ from the FIFO memory 308, while a code identifying the current print wheel position is supplied to inputs $A_4$ through $A_7$ of the ROM from a print wheel position register 312. The print wheel position register receives instantaneous print wheel position information over line 64 from the detent and shaft encoder circuitry 18. A code identifying the difference between the instantaneous position of the print wheel and the desired position, that is the character to be printed, is fed out of the ROM 310 to print wheel control logic 314 which simply determines if the print wheel is required to turn clockwise or counterclockwise and how many character intervals, as measured by pulses from clocking ring 150 of the code wheel must be traversed to reach the desired position. Selection of either fast or low speeds is determined by the angular distance between the current and desired print wheel positions. Similarly, once the print wheel reaches the desired position, the print wheel control logic actuates the lock output on line 164 to stop the rotary motion of the print wheel so that the desired character can be imprinted. In practice, it has been found desirable to actuate the lock output one character before the print wheel reaches its desired position so that the print wheel has an angular stopping distance equivalent to one character spacing.

Synchronization among the various components is maintained by sequence control logic 316 which is coupled to the computer 310 by a line 318, and is similarly coupled to the FIFO memory, the read only memory, the print wheel position register and the print wheel control logic by lines 320 through 326. The sequence control logic is similarly coupled by a line 328 by a conventional transport system 330 which may be any one of a large number of conventionally known document transport systems. The transport system supplies the sequence control logic with information indicating that a document is present for printing, and indicates the position of the document to the sequence control logic. The sequence control logic is coupled by a line 332 to paper advance logic 334 which carries out the advancement of the document during printing. The paper advance logic is coupled to the detent and shaft encoder 32 of the paper advance system by a line 164'.

Similarly, the sequence control logic is coupled via a line 336 to the hammer control logic 338 which is in turn coupled to the hammer control system by lines 340 and 342. The hammer control logic is simply a circuit for either advancing or retracting the hammer to carry out printing cycles.

Figure 9:
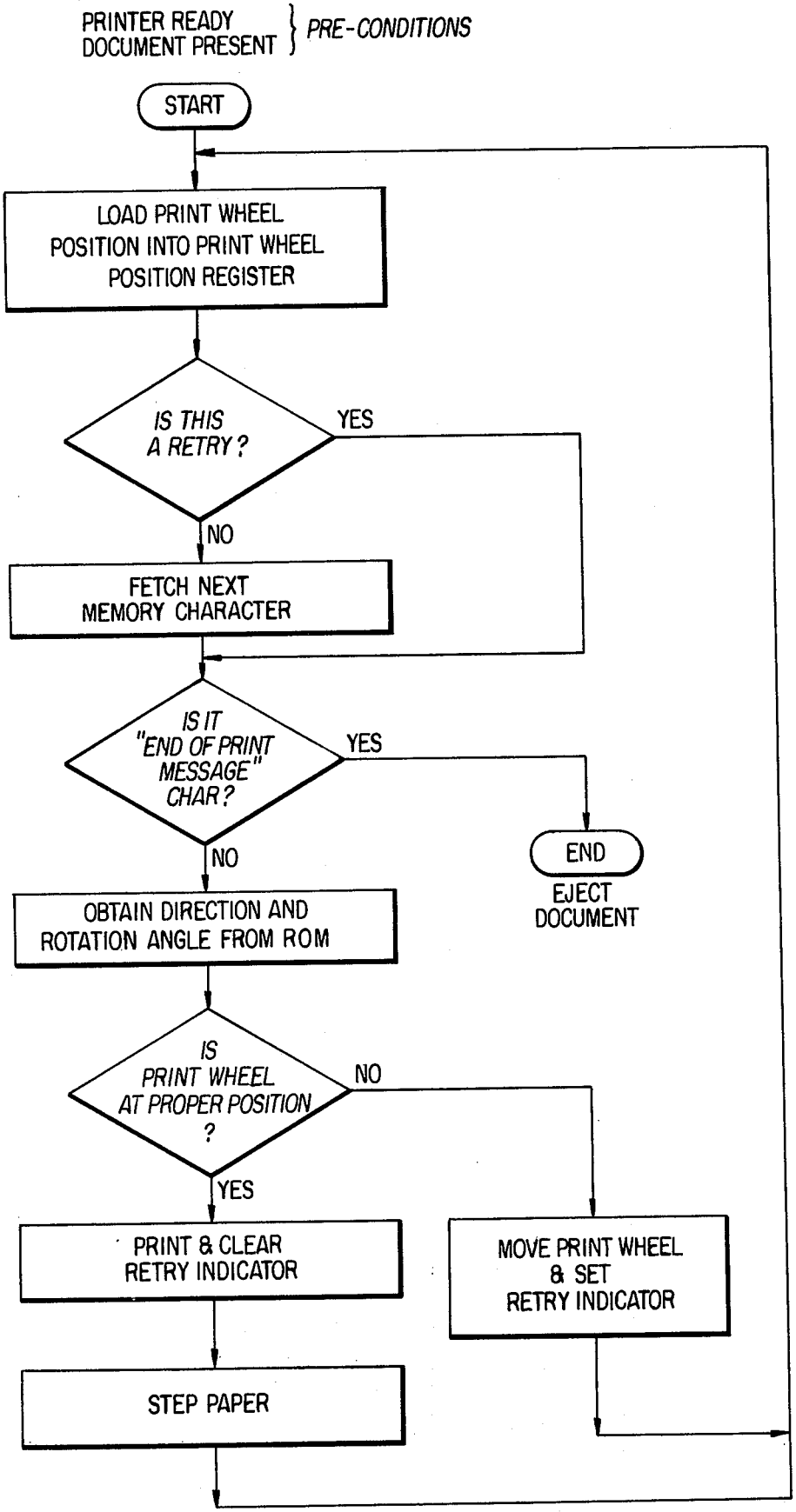
FIG. 9 is a logic block diagram in the form of a flow chart illustrating the logical steps performed by the sequence control logic of FIG. 8; and, FIG. 10 is an illustration of an enlarged portion of the code wheel of FIG. 2 showing the use of the code wheel in the detenting system of the invention.

Reference is now directed to FIG. 9 which is a flow chart illustrating the operation sequence of the digial logic system. The operating sequence is controlled by the sequence control logic 316 which may be either a standard hardwired logic network or it may be a general purpose computer programmed to carry out the illustrated functions. Referring now to FIG. 9, the printer must be ready for operation, that is have power supplied to it, and a document must be present in the system before the printing cycle is initiated. If these two conditions are met, the sequence control logic loads the print wheel position information from the detent and shaft encoder circuitry 18 into the print wheel position register 312. The sequence control logic then determines if it is trying to repeat the same step, or whether it is handling new information. If a "retry" is being attempted, the logic does not fetch a new character from the FIFO memory. If the information in question is new information and is not a "retry" the next character to be printed is fetched, that is, is read from the FIFO memory 308 into the ROM 310. If this character is the "end of print message character" the document is again ejected as the printing message is completed. If not, the sequence control logic causes the read only memory to feed the direction and rotation angle required of the print wheel to the print wheel control logic 314 so that the print wheel is put into rotation for a predetermined angular interval. When the rotational motion is complete the sequence control logic compares the new instantaneous print wheel position with the desired position, and if the two positions are not the same, print wheel motion is reinitiated and the retry indicator is set. In this case, the operating cycle of the sequence control logic is started again and is repeated until the print wheel reaches the desired position, at which time a print signal is supplied over the line 336 to actuate the hammer and carry out the printing step. At the same time, the retry indicator is cleared. After the printing step, the hammer is retracted and a signal is supplied over line 332 to the paper advance logic to advance the paper one step. At this point the sequence control logic cycle is again repeated and the next character is printed. The cycle is repeated until an end of message character is received, at which time the document is ejected.

The mode of operation of the present printer, as will be apparent from the discussion above, is not considered to be unique, and is not substantially different from other conventional printers. Accordingly, no unique circuit components or unusual logic functions are included in the digital logic control system set forth in the block 62. Thus the specific logic control circuits set forth in this block are considered to be conventional, and well known to those skilled in the art of printer controls and are not considered to in themselves comprise a significant aspect of the present invention. The present invention relates primarily to the circuitry and apparatus for implementing the functional steps required to carry out the printing operation in a highly efficient and reliable manner with a minimum of mechanical parts.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A system for controlling a print wheel comprising:

motive power means coupled to said print wheel for driving said print wheel, position encoding means coupled to said print wheel for providing an indication of the position of said print wheel, said position encoding means including a code wheel having a ring of alternately spaced opaque and transparent regions of equal length for providing a coded indication of the angular position of said print wheel, first electronic detenting means coupled to said print wheel for selectively locking said print wheel in printing position, said first electronic detenting means including a pair of spaced light emitting devices and a pair of similarly spaced photo sensitive switching means, said light emitting devices and said photo sensitive switching means being positioned on opposite sides of said code wheel so that said opaque and transparent regions pass therebetween, said light emitting devices being spaced from one another by a distance less than said length of said opaque regions.

paper advancing means coupled to said system for controlling the positioning of documents relative to said print wheel, and second electronic detenting means coupled to said paper advancing means for causing incremental movement thereof.

2. A system as in claim 1, further comprising:

print hammer means coupled to said system, said print hammer means including a print hammer, a hammer coil for driving the print hammer, and means for producing a current in one direction driving the hammer coil so that the hammer is retracted and for producing a current in the opposite direction driving the hammer coil so that the hammer is driven out to accomplish a printing operation.

3. A system as in claim 1 further comprising control circuit means for sequentially energizing said light emitting devices, said light emitting devices triggering selected ones of said photo sensitive switching means depending upon the position of said code wheel.

4. A system as in claim 1, wherein:

said first and second electronic detenting means are substantially identical in structure.

5. A system as in claim 1, further comprising:

control circuit means coupled to said motive power means for controlling the rotation of said print wheel.

6. A system as in claim 5, wherein said control circuit means comprises:

power amplifier means coupled to said motive power means; and, feedback circuit means coupled to said power amplifier means for controlling the output thereof.

7. A system as in claim 6, wherein said feedback circuit means comprises:

a differential amplifier having a resistive and capacitive feedback network coupled across it.

8. A system as in claim 6, wherein said control circuit means further comprises:

a plurality of electronic switching means coupled to said feedback circuit for determining the direction of rotation of said print wheel;

rate signal input circuit means coupled to said feedback circuit means for stabilizing the speed of said motive power means; and, holding signal circuit means coupled to said feedback circuit means for coupling said motive power means and said first electronic detenting means.

9. An electronic detenting circuit for holding a rotary element such as a print wheel in a selected position, comprising:

indicator wheel means coupled to said rotary element, said indicator wheel means including alternating regions of fixed length characterized by first and second detectable properties, detector circuit means including a pair of sensing elements positioned adjacent said indicator wheel means for detecting said regions by sensing said first and second properties, said sensing elements spaced from one another by a distance such that both sensing elements can be placed adjacent regions characterized by one of said first and second detectable properties and such that slight motion of said indicator wheel means will cause one of said sensing elements to move adjacent to a region characterized by the other of said first and second detectable properties; and, control circuit means coupled to said detector circuit means for generating a motive force resisting movement of said rotary element away from said selected position.

10. An electronic detenting circuit as in claim 9, wherein said indicator wheel means comprises:

a wheel having alternating transparent and opaque regions.

11. An electronic detenting circuit as in claim 10, wherein each of said sensing elements comprises:

a light emitting diode; and, a photo transistor positioned on the opposite side of said indicator wheel from said light emitting diode and positioned to receive light generated by said diode when a transparent region of said wheel separates said diode and said transistor.

12. An electronic detenting circit as in claim 11, wherein:

said photo transistors of said two sensing elements are coupled together in a push-pull mode.

13. An electronic detenting circuit as in claim 12, wherein said control circuit means comprises:

a differential amplifier coupled to said photo transistors, a power amplifier coupled to said differential amplifier; and, a motive power means coupled to said power amplifier and to said rotary element.

14. A print wheel and document advance apparatus control system comprising:

print wheel motor means coupled to said print wheel for rotating said print wheel, document advancing motor means coupled to said document advance apparatus, feedback control circuits coupled to said print wheel and document advancing motor means for controlling the speed of said motor means, opto-electronic detent means coupled to both said motor means for locking said print wheel and said document advance apparaus in selected positions, said detent means including a first coded indicator wheel coupled to said print wheel motor means and a second coded indicator wheel coupled to said document advancing motor means, first and second hybrid optical and electronic circuits for indicating movements of said indicator wheels and detent feedback circuitry for resisting movement of said motor means away from said selected positions; and, position indicating and selecting means coupled to said print wheel motor means for providing a continuous indication of the position of said print wheel and for driving said print wheel to desired printing positions, said position indicating and selecting means including a plurality of light emitting diodes positioned on one side of said first coded indicator wheel, decoder means coupled to said light emitting diodes for sequentially energizing said diodes in a predetermined sequence, and a plurality of photo transistors corresponding in number to said light emitting diodes for sensing the respective optical outputs thereof and positioned on the other side of said first coded indicator wheel, said photo transistors coupled to one another so as to provide a single output.

* * * * *